US007509817B2

(12) United States Patent
Hwang et al.

(10) Patent No.: US 7,509,817 B2
(45) Date of Patent: Mar. 31, 2009

(54) COOLING CYCLE APPARATUS AND METHOD OF CONTROLLING LINEAR EXPANSION VALVE OF THE SAME

(75) Inventors: Yoon Jei Hwang, Seoul (KR); Cheol Min Kim, Anyang-si (KR); Chang Min Choi, Seoul (KR); Seung Tak Kang, Seoul (KR); Hyung Soo Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 469 days.

(21) Appl. No.: 11/103,566

(22) Filed: Apr. 12, 2005

(65) Prior Publication Data

US 2005/0284163 A1 Dec. 29, 2005

(30) Foreign Application Priority Data

Apr. 12, 2004 (KR) ..... 10-2004-0025008

(51) Int. Cl.
*F25B 41/00* (2006.01)
*F25B 1/00* (2006.01)
*F25B 41/04* (2006.01)

(52) U.S. Cl. ..... 62/210; 62/212; 62/222; 62/225

(58) Field of Classification Search ..... 62/158, 62/196.2, 210, 212, 222, 224, 225, 226, 228.1
See application file for complete search history.

(56) References Cited

U.S. PATENT DOCUMENTS 5,224,354 A * 7/1993 Ito et al. ..... 62/210
5,546,756 A * 8/1996 Ali ..... 62/204
5,632,154 A * 5/1997 Sibik et al. ..... 62/99
6,318,101 B1 * 11/2001 Pham et al. ..... 62/225
6,564,565 B2 5/2003 Hwang
6,711,911 B1 * 3/2004 Grabon et al. ..... 62/225
2002/0139133 A1 10/2002 Hwang

FOREIGN PATENT DOCUMENTS

CN 1370956 9/2002

(Continued)

OTHER PUBLICATIONS

U.S. Appl. No. 10/914,087 to Jung et al., filed Aug. 10, 2004.

(Continued)

*Primary Examiner*—Chen-Wen Jiang
(74) *Attorney, Agent, or Firm*—Greenblum & Bernstein, P.L.C.

(57) ABSTRACT

Disclosed herein is a method of controlling a linear expansion valve of a cooling cycle apparatus. The method comprises a first step of calculating a target opening level value according to suction overheat level of compressors to control a linear expansion valve based on the calculated target opening level value, and a second step of calculating a new target opening level value according to the suction overheat level of the compressors and discharge temperature of the compressors to control the linear expansion valve based on the calculated new target opening level value. Consequently, the discharge temperature of the compressors is prevented from being excessively increased, and therefore, the compressors are prevented from being overheated and damaged, and reliability of the cooling cycle apparatus is improved.

16 Claims, 6 Drawing Sheets

FOREIGN PATENT DOCUMENTS

| | | |
|---|---|---|
| JP | 2003-0 2 8 5 1 9 | 1/2003 |
| KR | 1996-8212 | 6/1996 |

OTHER PUBLICATIONS

U.S. Appl. No. 10/914,080 to Jung et al., filed Aug. 10, 2004.
U.S. Appl. No. 10/914,079 to Chin et al., filed Aug. 10, 2004.
U.S. Appl. No. 10/984,970 to Lee et al. , filed Aug. 10, 2004.
English Language Abstract of KR 1996-8212.
English Language Abstract of CN 1370956. Sep. 25, 2002.
English Language Abstract of JP 2003-028519.

* cited by examiner

COOLING CYCLE APPARATUS AND METHOD OF CONTROLLING LINEAR EXPANSION VALVE OF THE SAME

BACKGROUND OF THE INVENTION

1. Field of the Invention

The present invention relates to a cooling cycle apparatus and a method of controlling a linear expansion valve of the same, and, more particularly, to a cooling cycle apparatus and a method of controlling a linear expansion valve of the same that is capable of controlling the linear expansion valve based on suction overheat level of compressors, whereby the cooling cycle apparatus quickly deals with load, and therefore, reliability of the cooling cycle apparatus is improved.

2. Description of the Related Art

Generally, a cooling cycle apparatus is an apparatus that cools or heats the interior of a room where a specific component of the cooling cycle apparatus is installed. The cooling cycle apparatus comprises a compressor, a condenser, an expansion mechanism, and a vaporizer.

In recent years, a plurality of compressors have been mounted in cooling cycle apparatuses, or a liner compressor whose compression capacity is variable has been mounted in cooling cycle apparatuses, in order to properly operate the cooling cycle apparatuses based on cooling load or heating load. Also, a linear expansion valve has been used to control the expansion level of the expansion mechanism when the compression capacity of the compressor is to be controlled.

For convenience, a description of a heat pump type cooling cycle apparatus, which is operated not only in cooling operation mode but also in heating operation mode, will be given hereinafter.

FIG. 1 is a circuit diagram showing the flow of refrigerant when a conventional cooling cycle apparatus is operated in cooling operation mode, and FIG. 2 is a circuit diagram showing the flow of refrigerant when the conventional cooling cycle apparatus is operated in heating operation mode.

As shown in FIGS. 1 and 2, the conventional cooling cycle apparatus comprises: a pair of compressors 1*a* and 1*b* for compressing low-temperature and low-pressure gas refrigerant into high-temperature and high-pressure gas refrigerant; an outdoor heat exchanger 4 for performing heat exchange between the refrigerant and outdoor air to condense/vaporize the refrigerant; an indoor heat exchanger 6 for performing heat exchange between the refrigerant and indoor air to vaporize/condense the refrigerant; and a linear expansion valve 8 for expanding the refrigerant condensed by one of the outdoor and indoor heat exchangers to decompress the condensed refrigerant such that the decompressed refrigerant is introduced into the other of the outdoor and indoor heat exchangers.

On the common inlet pipe of the compressors 1*a* and 1*b* is mounted an accumulator 10 for accumulating liquid refrigerant to prevent the liquid refrigerant from being introduced into the compressors 1*a* and 1*b*.

On the outlet pipes of the compressors 1*a* and 1*b* are mounted check valves 3*a* and 3*b* for preventing back-flow of the refrigerant, respectively.

On the common outlet pipe of the compressors 1*a* and 1*b* is mounted a four-way valve 12 for changing flow of the refrigerant according to selected operation mode, i.e., cooling operation mode or heating operation mode.

The opening level value of the linear expansion valve 8 is increased or decreased to control the flow rate of the refrigerant according to cooling load or heating load. The increase and decrease of the opening level value of the linear expansion valve 8 are decided according to comparison between the desired temperature and the current temperature.

The cooling cycle apparatus further comprises: a microcomputer 20 for controlling the four-way valve 12 according to the cooling operation mode or heating operation mode, and controlling the compressors 1*a* and 1*b* and the linear expansion valve 8 according to the cooling load or the heating load.

In the conventional cooling cycle apparatus and the method of controlling the linear expansion valve of the conventional cooling cycle apparatus, however, the linear expansion valve 8 is controlled according to comparison between the desired temperature and the current temperature. Consequently, when the length of the pipes is increased or the amount of refrigerant is not sufficient, the cooling cycle apparatus does not quickly deal with load. Furthermore, discharge temperature of the compressors 1*a* and 1*b* is increased, and therefore, the compressors 1*a* and 1*b* are damaged.

SUMMARY OF THE INVENTION

Therefore, the present invention has been made in view of the above problems, and it is an object of the present invention to provide a cooling cycle apparatus and a method of controlling a linear expansion valve of the same that is capable of controlling the linear expansion valve based on suction overheat level of the compressors, whereby the cooling cycle apparatus quickly deals with load, and therefore, reliability of the cooling cycle apparatus is improved.

In accordance with one aspect of the present invention, the above and other objects can be accomplished by the provision of a cooling cycle apparatus comprising: compressors for compressing refrigerant; an outdoor heat exchanger for performing heat exchange between the refrigerant and outdoor air to condense/vaporize the refrigerant; an indoor heat exchanger for performing heat exchange between the refrigerant and indoor air to vaporize/condense the refrigerant; a linear expansion valve for expanding the refrigerant condensed by one of the outdoor and indoor heat exchangers to decompress the condensed refrigerant such that the decompressed refrigerant is introduced into the other of the outdoor and indoor heat exchangers; a suction overheat level measuring unit for measuring suction overheat level of the compressors; a discharge pipe sensor for measuring discharge temperature of the compressors; and a microcomputer for controlling the linear expansion valve according to the suction overheat level measured by the suction overheat level measuring unit and the discharge temperature measured by the discharge pipe sensor.

Preferably, the suction overheat level measuring unit comprises: an inlet pipe sensor for measuring temperature of the refrigerant introduced into the compressors; an outdoor pipe sensor for measuring temperature of an outdoor pipe of the outdoor heat exchanger; and an indoor pipe sensor for measuring temperature of an indoor pipe of the indoor heat exchanger.

Preferably, the compressors comprise an inverter-type compressor and a constant-speed type compressor.

In accordance with another aspect of the present invention, there is provided a method of controlling a linear expansion valve of a cooling cycle apparatus, wherein an opening level value of the linear expansion valve is controlled based on suction overheat level of compressors of the cooling cycle apparatus.

In accordance with yet another aspect of the present invention, there is provided a method of controlling a linear expansion valve of a cooling cycle apparatus, wherein the method comprises: a first step of calculating a target opening level value according to suction overheat level of compressors for compressing refrigerant to control a linear expansion valve based on the calculated target opening level value; and a second step of calculating a new target opening level value according to the suction overheat level of the compressors and discharge temperature of the compressors to control the linear expansion valve based on the calculated new target opening level value.

Preferably, the first step comprises: a first sub-step of calculating overheat level, which is the difference between the temperature of the inlet pipes of the compressors and the temperature of the indoor pipe (or the outdoor pipe); a second sub-step of calculating current overheat level error, which is the difference between the overheat level calculated at the first sub-step and target overheat level, at predetermined time intervals; a third sub-step of calculating a slope of the current overheat level error from the current overheat level error calculated at the second sub-step and overheat level error a predetermined period of time in the past; a fourth sub-step of calculating an opening level increase or decrease value according to the slope of the current overheat level error calculated at the third sub-step; and a fifth sub-step of calculating an opening level change value according to the slope of the current overheat level error calculated at the third sub-step and the opening level increase or decrease value calculated at the fourth sub-step.

Preferably, the second step is performed a predetermined period of time after the operation of the compressors is initiated.

Preferably, the second step comprises: a first sub-step of calculating a first opening level change value of the linear expansion valve according to the suction overheat level of the compressors; a second sub-step of calculating a second opening level change value of the linear expansion valve according to the discharge temperature of the compressors; a third sub-step of adding the first opening level change value calculated at the first sub-step and the second opening level change value calculated at the second sub-step to calculate a final opening level change value; and a fourth sub-step of adding the current opening level value to the final opening level change value calculated at the third sub-step to calculate a new target opening level value.

Preferably, the first sub-step comprises: a first operation of calculating overheat level, which is the difference between the temperature of the inlet pipes of the compressors and the temperature of the indoor (or outdoor) pipe; a second operation of calculating current overheat level error, which is the difference between the overheat level calculated at the first operation and the target overheat level, at predetermined time intervals; a third operation of calculating a slope of the current overheat level error from the current overheat level error calculated at the second operation and overheat level error a predetermined period of time in the past; a fourth operation of calculating an opening level increase or decrease value according to the slope of the current overheat level error calculated at the third operation; and a fifth operation of calculating the first opening level change value from the slope of the current overheat level error calculated at the third operation and the opening level increase or decrease value calculated at the fourth operation.

Preferably, the second sub-step comprises: a first operation of calculating target compressor discharge temperature according to indoor temperature, outdoor temperature, and operating capacities of the compressors; a second operation of calculating current compressor discharge temperature error, which is the difference between the current compressor discharge temperature and the target compressor discharge temperature, at predetermined time intervals; a third operation of calculating an opening level increase or decrease value according to the current compressor discharge temperature error calculated at the second operation and the operating capacities of the compressors; a fourth operation of calculating a slope of the compressor discharge temperature error from the current compressor discharge temperature error calculated at the second operation and compressor discharge temperature error a predetermined period of time in the past; and a fifth operation of calculating the second opening level change value from the opening level increase or decrease value calculated at the third operation and the slope of the compressor discharge temperature error calculated at the fourth operation.

As the cooling cycle apparatus according to the present invention comprises: the suction overheat level measuring unit for measuring the suction overheat level of the compressors; the discharge pipe sensor for measuring the discharge temperature of the compressors; and the microcomputer for controlling the linear expansion valve according to the suction overheat level measured by the suction overheat level measuring unit and the discharge temperature measured by the discharge pipe sensor, the linear expansion valve is controlled based on the suction overheat level and the discharge temperature of the compressors. Consequently, the cooling cycle apparatus quickly deals with load, and therefore, reliability of the cooling cycle apparatus is improved.

The method of controlling the linear expansion valve of the cooling cycle apparatus controls the opening level value of the linear expansion valve based on the discharge temperature of the compressors as well as the suction overheat level of the compressors. Consequently, the present invention has the effect of preventing the discharge temperature of the compressors from being excessively increased, and therefore, preventing the compressors from being overheated and damaged. Furthermore, reliability of the cooling cycle apparatus is improved.

Also, the method of controlling the linear expansion valve of the cooling cycle apparatus calculates the target opening level value according to the suction overheat level of the compressors to control the liner expansion valve for a predetermined period of time after the compressors are operated, since the discharge temperature of the compressors is relatively low, and calculates the new target opening level value according to the suction overheat level and the discharge temperature of the compressors to control the linear expansion valve a predetermined period of time after the operation of the compressors is initiated. Consequently, the present invention has the effect of optimizing efficiency of the cooling cycle apparatus.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
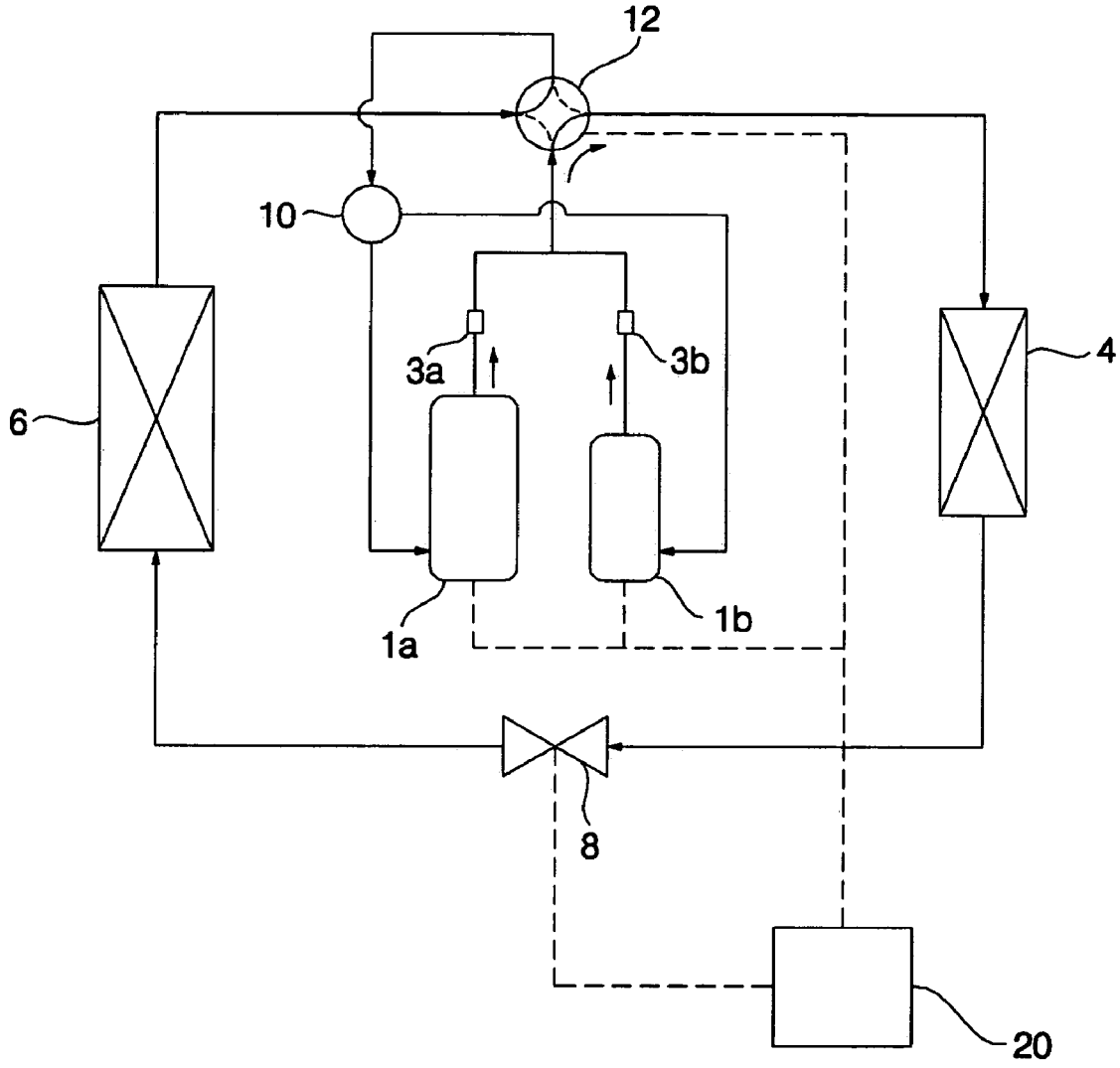
FIG. 1 (Prior art)
FIG. 1 is a circuit diagram showing the flow of refrigerant when a conventional cooling cycle apparatus is operated in cooling operation mode.
Figure 2:
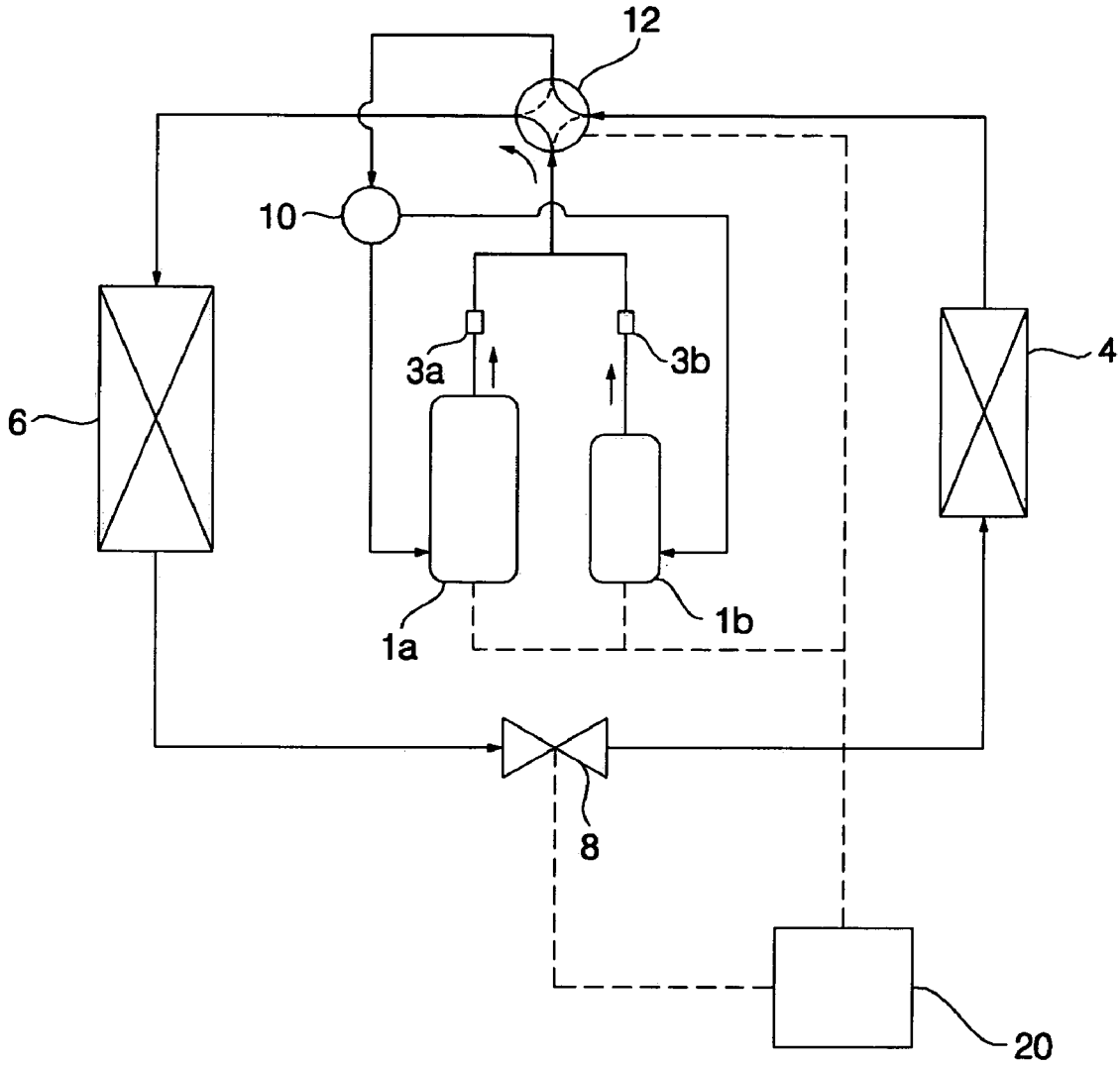
FIG. 2 (Prior art)
FIG. 2 is a circuit diagram showing the flow of refrigerant when the conventional cooling cycle apparatus is operated in heating operation mode.

Now, preferred embodiments of the present invention will be described in detail with reference to the accompanying drawings. The same or similar elements are denoted by the same reference numerals even though they are depicted in different drawings, and a detailed description thereof will be omitted.

Figure 3:
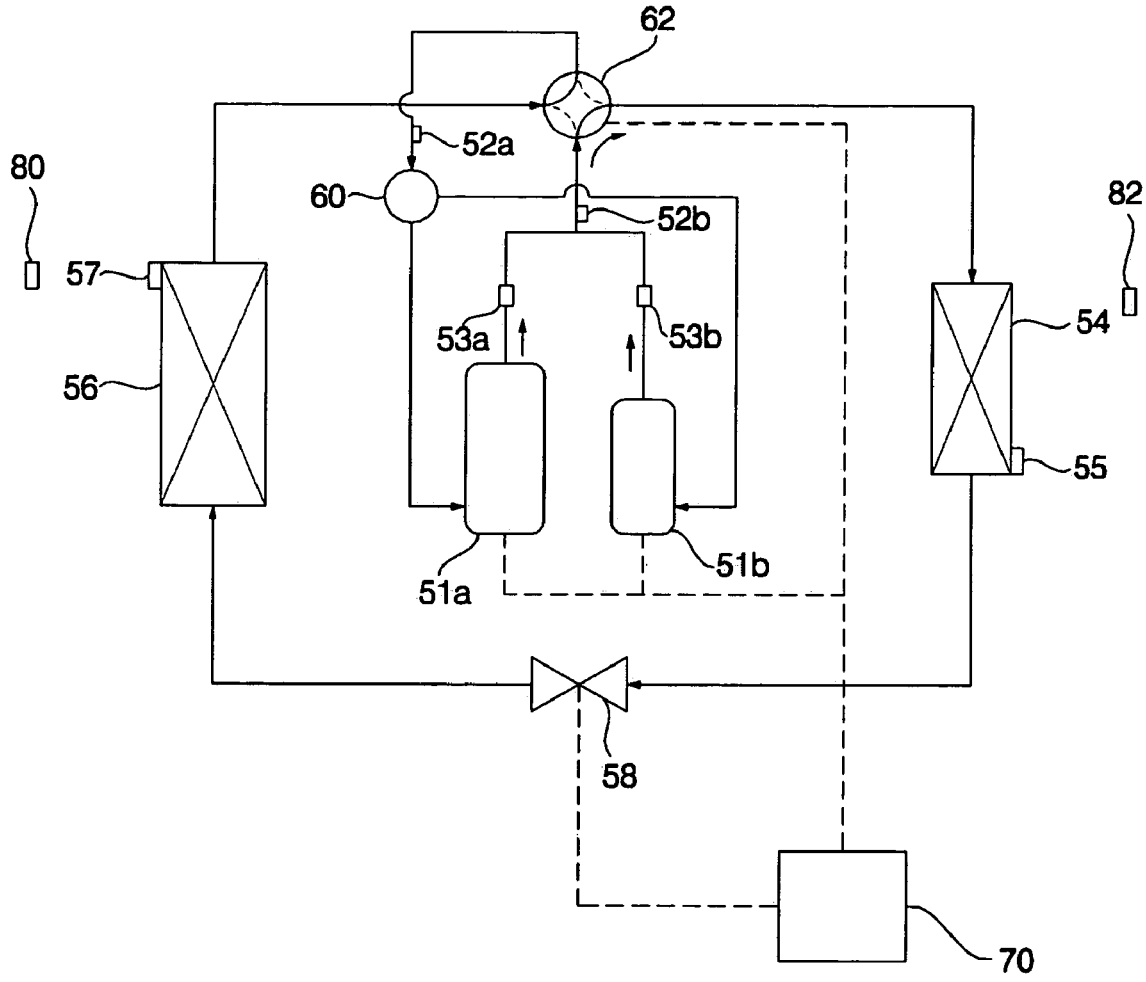
FIG. 3 is a circuit diagram showing the flow of refrigerant when a cooling cycle apparatus according to the present invention is operated in cooling operation mode.
Figure 4:
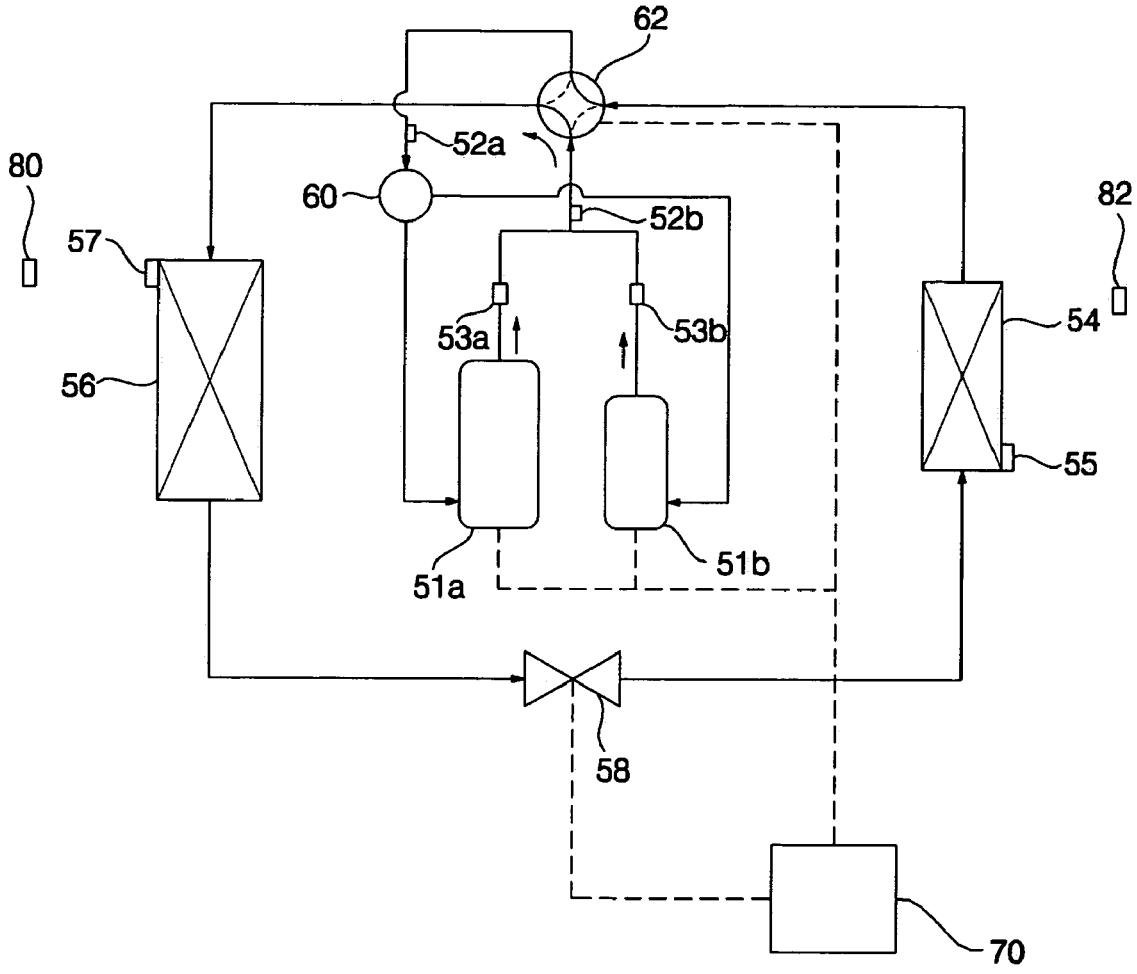
FIG. 4 is a circuit diagram showing the flow of refrigerant when the cooling cycle apparatus according to the present invention is operated in heating operation mode.

FIG. 3 is a circuit diagram showing the flow of refrigerant when a cooling cycle apparatus according to the present invention is operated in cooling operation mode, and FIG. 4 is a circuit diagram showing the flow of refrigerant when the cooling cycle apparatus according to the present invention is operated in heating operation mode.

As shown in FIGS. 3 and 4, the cooling cycle apparatus according to the present invention comprises: a pair of compressors 51*a* and 51*b* for compressing low-temperature and low-pressure gas refrigerant into high-temperature and high-pressure gas refrigerant; an outdoor heat exchanger 54 for performing heat exchange between the refrigerant and outdoor air to condense/vaporize the refrigerant; an indoor heat exchanger 56 for performing heat exchange between the refrigerant and indoor air to vaporize/condense the refrigerant; a linear expansion valve 58 for expanding the refrigerant condensed by one of the outdoor and indoor heat exchangers to decompress the condensed refrigerant such that the decompressed refrigerant is introduced into the other of the outdoor and indoor heat exchangers; an accumulator 60 mounted on the common inlet pipe of the compressors 51*a* and 51*b* for accumulating liquid refrigerant to prevent the liquid refrigerant from being introduced into the compressors 51*a* and 51*b;* a four-way valve 62 mounted on the common outlet pipe of the compressors 51*a* and 51*b* for changing flow of the refrigerant according to selected operation mode, i.e., cooling operation mode or heating operation mode; and a microcomputer 70 for controlling the four-way valve 62 according to the cooling operation mode or heating operation mode, and controlling the compressors 51*a* and 51*b* and the linear expansion valve 58 according to cooling load or heating load.

On the common inlet pipe of the compressors 51*a* and 51*b* is mounted an inlet pipe sensor 52*a* for measuring temperature of the refrigerant introduced into the compressors 51*a* and 51*b*.

On the common outlet pipe of the compressors 51*a* and 51*b* is mounted an outlet pipe sensor 52*b* for measuring temperature of the refrigerant discharged from the compressors 51*a* and 51*b*.

On the outlet pipes of the compressors 51*a* and 51*b* are mounted check valves 53*a* and 53*b* for preventing back-flow of the refrigerant, respectively.

At the outdoor heat exchanger 54 is mounted an outdoor pipe sensor 55 for measuring temperature of an outdoor pipe.

At the indoor heat exchanger 56 is mounted an indoor pipe sensor 57 for measuring temperature of an indoor pipe.

Also, the cooling cycle apparatus further comprises an indoor temperature sensor 80 for sensing indoor temperature and an outdoor temperature sensor 82 for sensing outdoor temperature.

When the cooling cycle apparatus is operated in the cooling operation mode, refrigerant discharged from the compressors 51 and 51*b* flows through the four-way valve 62, the outdoor heat exchanger 54, the linear expansion valve 58, the indoor heat exchanger 56, the four-way valve 62, and the accumulator 60. The refrigerant passing through the accumulator 60 is introduced into the compressors 51*a* and 51*b*.In this way, the refrigerant is circulated. During circulation of the refrigerant, the indoor heat exchanger 56 serves as a vaporizer to cool the indoor air.

When the cooling cycle apparatus is operated in the heating operation mode, on the other hand, refrigerant discharged from the compressors 51 and 51*b* flows through the four-way valve 62, the indoor heat exchanger 56, the linear expansion valve 58, the outdoor heat exchanger 54, the four-way valve 62, and the accumulator 60. The refrigerant passing through the accumulator 60 is introduced into the compressors 51*a* and 51*b*. In this way, the refrigerant is circulated. During circulation of the refrigerant, the indoor heat exchanger 56 serves as a condenser to heat the indoor air.

The compressors 51*a* and 51*b* may be constant-speed type compressors or inverter-type compressors that are operated in variable speed. Alternatively, the compressors 51*a* and 51*b* may comprise an inverter-type compressor 51*a* and a constant-speed type compressor 51*b*. For convenience, a detailed description of the compressors 51*a* and 51*b,* which comprises the inverter-type compressor 51*a* and a constant-speed type compressor 51*b,* will be given hereinafter.

When cooling load or heating load is small, the inverter-type compressor 51*a,* which is one of the compressors 51*a* and 51*b,* is operated at low speed to deal with the load. As the cooling load or the heating load is increased, the inverter-type compressor 51*a* is operated at high speed to deal with the increased load. When the load is not properly dealt with, however, the inverter-type compressor 51*a* and the constant-speed type compressor 51*b* are simultaneously operated to deal with the load.

The opening level value of the linear expansion valve 58 is increased or decreased to control the flow rate of the refrigerant according to the cooling load or the heating load. The increase and decrease of the opening level value of the linear expansion valve 58 are decided according to suction overheat level of the compressors and discharge temperature of the compressors.

Figure 5:
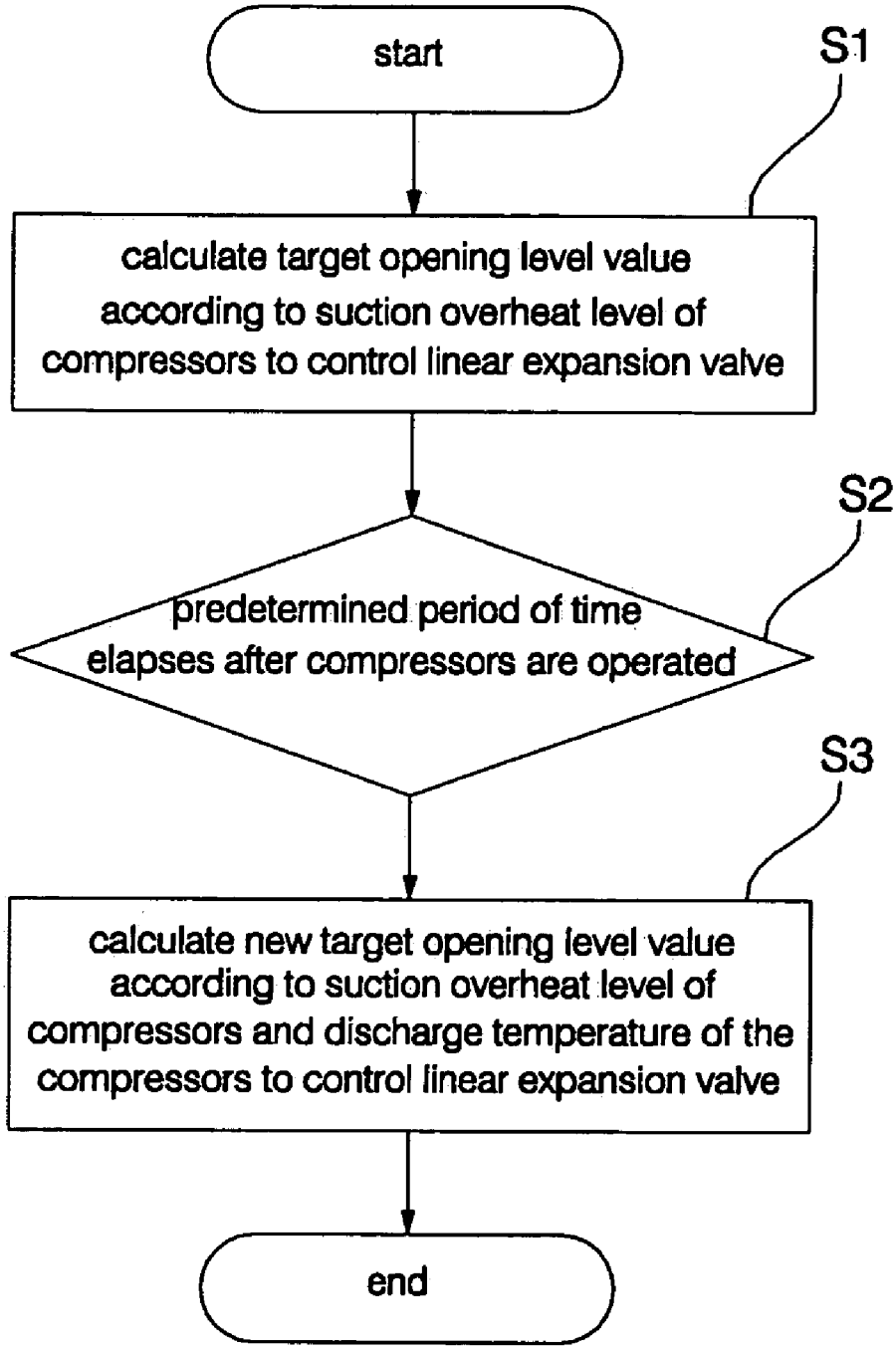
FIG. 5 is a flow chart illustrating a method of controlling a linear expansion valve of the cooling cycle apparatus according to the present invention.

FIG. 5 is a flow chart illustrating a method of controlling a linear expansion valve of the cooling cycle apparatus according to the present invention.

As a first step of the method of controlling a linear expansion valve of the cooling cycle apparatus according to the present invention, the target opening level value of the linear expansion valve 58 is calculated according to the suction overheat level of the compressors 51*a* and 51*b* to control the linear expansion valve 58 based on the calculated target opening level value of the linear expansion valve 58 (S1).

The suction overheat level of the compressors 51*a* and 51*b* is controlled as follows: the current overheat level (SHp), which is the difference between the temperature of the inlet pipes of the compressors and the temperature of the indoor pipe (or the outdoor pipe when the cooling cycle apparatus is operated in the heating operation mode), is calculated, and then the current overheat level error (Ep), which is the difference between the calculated current overheat level (SHp) and the target overheat level, is calculated.

The target overheat level is the overheat level when the cooling cycle apparatus is operated with the maximum performance in the cooling operation mode or the heating operation mode. The target overheat level is previously set based on the flow rate of refrigerant.

The current overheat level error (Ep) is calculated at predetermined time intervals, for example, at 30-second intervals, and then the difference between overheat level error a predetermined period of time (Ep') in the past and the current overheat level error (Ep) is calculated to calculate a slope of the overheat level error. The opening level increase or decrease value according to the slope of the overheat level error (Ep) is calculated from a table previously set by experimentation.

Subsequently, the slope of the overheat level error (Ep) and the opening level increase or decrease value are substituted into a predetermined mathematic equation to finally calculate an opening level change value.

The predetermined mathematic equation is differently decided according to the number of the compressors 51*a* and 51*b* being operated. Also, the predetermined mathematic equation is differently decided according to the slope of the overheat level error.

For example, when the compressors 51*a* and 51*b* are simultaneously operated, and the slope of the overheat level error (Ep) is greater than 0, the opening level change value is calculated by Equation 1.

opening level change value=*A*×opening level increase or decrease value+*B*×slope of overheat level error×opening level increase or decrease value [Equation 1]

where, A and B are values previously set according to the capacities of the compressors.

When the compressors 51*a* and 51*b* are simultaneously operated, and the slope of the overheat level error (Ep) is less than 0, the opening level change value is calculated by Equation 2.

opening level change value=*A*×opening level increase or decrease value−*B*×slope of overheat level error×opening level increase or decrease value [Equation 2]

When only one of the compressors 51*a* and 51*b* is operated, on the other hand, the opening level change value is calculated by Equation 3.

opening level change value=*C*×opening level increase or decrease value+*D*×slope of overheat level error [Equation 3]

where, C and D are values previously set according to the capacities of the compressors.

When the opening level change value is decided as described above, the microcomputer 20 adds the current opening level value of the linear expansion valve 59 to the opening level change value calculated by Equation 1, 2 or 3 to calculate the target opening level value, and then control the linear expansion valve 58 based on the calculated target opening level value.

A second step of the method of controlling a linear expansion valve of the cooling cycle apparatus according to the present invention is performed as follows: when a predetermined period of time elapses after the compressors 51*a* and 51*b* are operated, a new target opening level value is calculated according to the suction overheat level of the compressors 51*a* and 51*b* and the discharge temperature of the compressors 51*a* and 51*b*, and then the linear expansion valve 58 is controlled based on the calculated new target opening level value (S2, S3).

Figure 6:
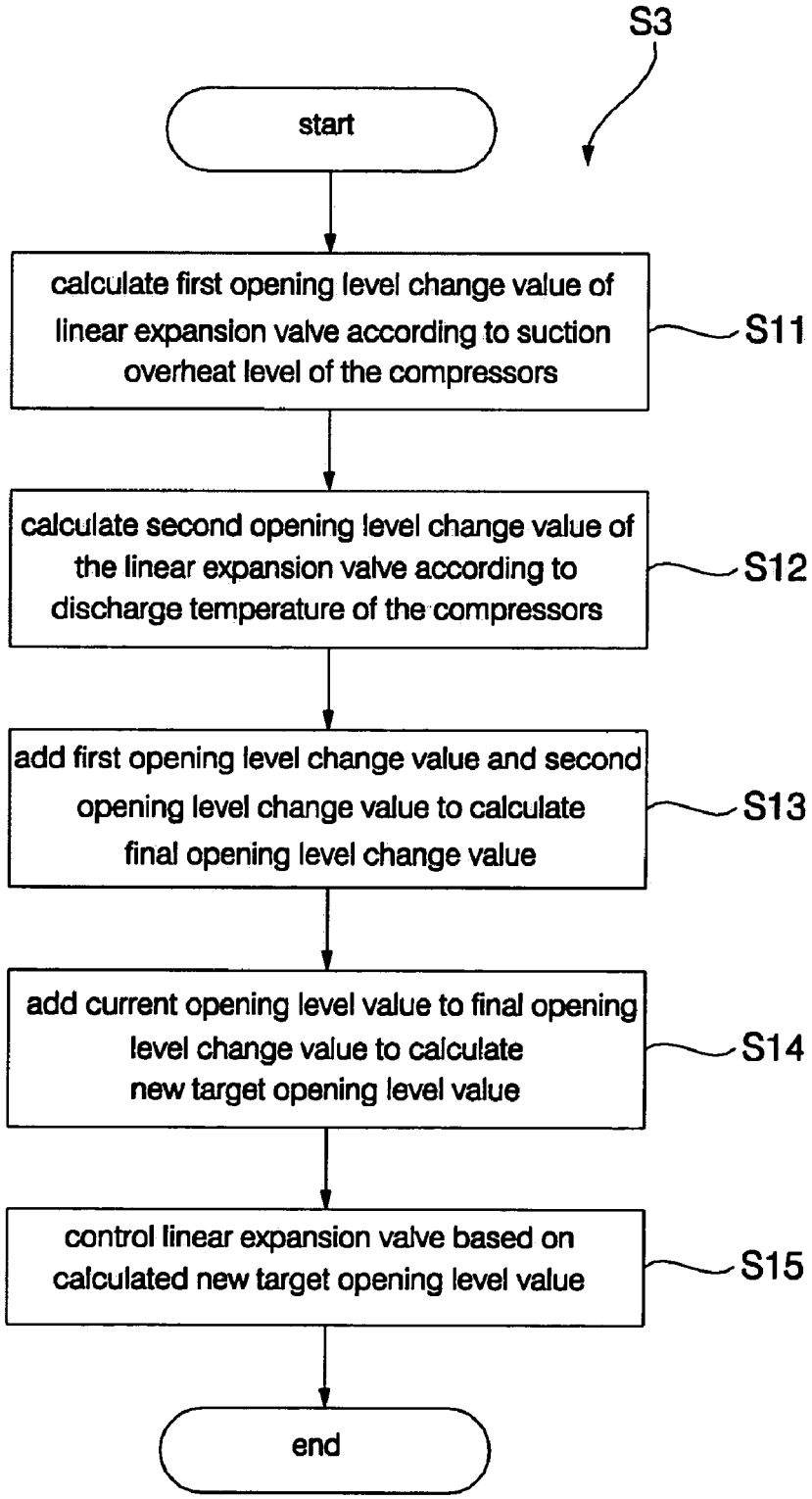
FIG. 6 is a flow chart illustrating a step of calculating a new target opening level value and controlling the liner expansion valve based on the calculated target opening level value illustrated in FIG. 5.

FIG. 6 is flow chart illustrating a step of calculating the new target opening level value and controlling the liner expansion valve based on the calculated target opening level value illustrated in FIG. 5.

The new target opening level value calculating step begins with a first sub-step of calculating a first opening level change value of the linear expansion valve according to the suction overheat level of the compressors 51*a* and 51*b* (S11).

As a first operation of the first sub-step S11, the overheat level (SHp), which is the difference between the temperature of the inlet pipes of the compressors and the temperature of the indoor (or outdoor) pipe, is calculated.

As a second operation of the first sub-step S11, the current overheat level error (Ep), which is the difference between the overheat level (SHp) calculated at the first operation and the target overheat level, is calculated at predetermined time intervals, for example, at 30-second intervals.

As a third operation of the first sub-step S11, the slope of the current overheat level error is calculated from the current overheat level error (Ep) calculated at the second operation and overheat level error a predetermined period of time (Ep') in the past.

As a fourth operation of the first sub-step S11, the opening level increase or decrease value according to the slope of the current overheat level error is calculated from a table previously set by experimentation.

As a fifth operation of the first sub-step S11, the slope of the current overheat level error calculated at the third operation and the opening level increase or decrease value calculated at the fourth operation are substituted into a predetermined mathematic equation to calculate the first opening level change value.

The predetermined mathematic equation is differently decided according to the number of the compressors 51*a* and 51*b* being operated, as in the first step. Also, the predetermined mathematic equation is differently decided according to the slope of the overheat level error (Ep).

For example, when the compressors 51*a* and 51*b* are simultaneously operated, and the slope of the overheat level error (Ep) is greater than 0, the first opening level change value is calculated by Equation 4.

first opening level change value=*A*×opening level increase or decrease value+*B*×slope of overheat level error ×opening level increase or decrease value [Equation 4]

where, A and B are values previously set according to capacities of the compressors.

When the compressors 51*a* and 51*b* are simultaneously operated, and the slope of the overheat level error (Ep) is less than 0, the first opening level change value is calculated by Equation 5.

first opening level change value=*A*∴opening level increase or decrease value−*B*×slope of overheat level error ×opening level increase or decrease value [Equation 5]

When only one of the compressors 51*a* and 51*b* is operated, on the other hand, the first opening level change value is calculated by Equation 6.

first opening level change value=*C*×opening level increase or decrease value+*D*×slope of overheat level error [Equation 6]

where, C and D are values previously set according to capacities of the compressors.

As a second sub-step of the new target opening level value calculating step, a second opening level change value of the linear expansion valve according to the discharge temperature of the compressors 51*a* and 51*b* is calculated (S12).

As a first operation of the second sub-step S12, target compressor discharge temperature is calculated according to the indoor temperature, the outdoor temperature, and the operating capacities of the compressors 51*a* and 51*b*.

The target compressor discharge temperature is differently decided as expressed by Equations 7 and 8 according to the selected operation mode, i.e., the cooling operation mode or the heating operation mode.

target compressor discharge temperature in cooling operation mode=$f$(indoor temperature, outdoor temperature, operating capacities of compressors) =(indoor temperature−35)×$C1$+(27−indoor temperature)×$C2$+$C3$ [Equation 7]

where, C1, C2 and C3 are values previously set according to the capacities of the compressors.

target compressor discharge temperature in heating operation mode=$f$(indoor temperature, outdoor temperature, operating capacities of compressors) =(outdoor temperature−7)×$C4$+(indoor temperature−20) ×$C5$+$C6$ [Equation 8]

where, C4, C5 and C6 are values previously set according to the capacities of the compressors.

As a second operation of the second sub-step S12, the current compressor discharge temperature error (Etd), which is the difference between the current compressor discharge temperature and the target compressor discharge temperature, is calculated at predetermined time intervals.

As a third operation of the second sub-step S12, the opening level increase or decrease value according to the current compressor discharge temperature error (Etd) calculated at the second operation and the operating capacities of the compressors is calculated from a table previously set by experimentation.

As a fourth operation of the second sub-step S12, the slope of the compressor discharge temperature error (Etd) is calculated from the current compressor discharge temperature error (Etd) calculated at the second operation and compressor discharge temperature error a predetermined period of time (Etd') in the past.

As a fifth operation of the second sub-step S12, the opening level increase or decrease value calculated at the third operation and the slope of the compressor discharge temperature error (Etd) are substituted into a predetermined mathematic equation to calculate the second opening level change value.

The predetermined mathematic equation is differently decided according to the number of the compressors 51*a* and 51*b* being operated, as in the first step. Also, the predetermined mathematic equation is differently decided according to the slope of the compressor discharge temperature error (Etd).

For example, when the compressors 51*a* and 51*b* are simultaneously operated, and the slope of the compressor discharge temperature error (Etd) is greater than 0, the second opening level change value is calculated by Equation 9.

second opening level change value=$E$×opening level increase or decrease value+$F$×slope of compressor discharge temperature error×opening level increase or decrease value [Equation 9]

where, E and F are values previously set according to the capacities of the compressors.

When the compressors 51*a* and 51*b* are simultaneously operated, and the slope of the compressor discharge temperature error (Etd) is less than 0, the second opening level change value is calculated by Equation 10.

second opening level change value=$E$×opening level increase or decrease value−$F$×slope of compressor discharge temperature error×opening level increase or decrease value [Equation 10]

When only one of the compressors 51*a* and 51*b* is operated, on the other hand, the second opening level change value is calculated by Equation 11.

second opening level change value=$G$×opening level increase or decrease value+$H$×slope of compressor discharge temperature error [Equation 11]

where, G and H are values previously set according to the capacities of the compressors.

As a third sub-step of the new target opening level value calculating step, the first opening level change value calculated at the first sub-step S11 and the second opening level change value calculated at the second sub-step S12 are added to calculate a final opening level change value (S13).

As a fourth sub-step of the new target opening level value calculating step, the current opening level value is added to the final opening level change value calculated at the third sub-step S13 to calculate the new target opening level value (S14).

Subsequently, the linear expansion valve 58 is controlled according to the calculated new target opening level value.

In the illustrated embodiment, the number of the compressors is two, although more than two compressors may be used, which does not depart from the scope and spirit of the invention.

The present invention with the above-stated construction has the following effects.

As the cooling cycle apparatus according to the present invention comprises: the suction overheat level measuring unit for measuring the suction overheat level of the compressors; the discharge pipe sensor for measuring the discharge temperature of the compressors; and the microcomputer for controlling the linear expansion valve according to the suction overheat level measured by the suction overheat level measuring unit and the discharge temperature measured by the discharge pipe sensor, the linear expansion valve is controlled based on the suction overheat level and the discharge temperature of the compressors. Consequently, the cooling cycle apparatus quickly deals with load, and therefore, reliability of the cooling cycle apparatus is improved.

The method of controlling the linear expansion valve of the cooling cycle apparatus controls the opening level value of the linear expansion valve based on the discharge temperature of the compressors as well as the suction overheat level of the compressors. Consequently, the present invention has the effect of preventing the discharge temperature of the compressors from being excessively increased, and therefore, preventing the compressors from being overheated and damaged. Furthermore, reliability of the cooling cycle apparatus is improved.

Also, the method of controlling the linear expansion valve of the cooling cycle apparatus calculates the target opening level value according to the suction overheat level of the compressors to control the liner expansion valve for a predetermined period of time after the compressors are operated, since the discharge temperature of the compressors is relatively low, and calculates the new target opening level value according to the suction overheat level and the discharge temperature of the compressors to control the linear expansion valve a predetermined period of time after the operation of the compressors is initiated. Consequently, the present invention has the effect of optimizing efficiency of the cooling cycle apparatus.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The present disclosure relates to subject matter contained in Korean Application No. 10-2004-0025008, filed on Apr. 12, 2004, the contents of which are herein expressly incorporated by reference in its entirety.

What is claimed is:

1. A method of controlling a linear expansion valve of a cooling cycle apparatus, comprising:

calculating a target opening level value based on a suction overheat level of a plurality of compressors;

controlling a linear expansion valve based on the calculated target opening level value for a predetermined period of time after the compressors are operated;

calculating a new target opening level value based on the suction overheat level of the compressors and a discharge temperature of the compressors; and controlling the linear expansion valve based on the calculated new target opening level value after the predetermined period of time has elapsed.

2. The method as set forth in claim 1, wherein calculating the target opening level value comprises:

calculating an overheat level, which is a difference between a temperature of inlet pipes of the compressors and a temperature of an indoor pipe or an outdoor pipe;

calculating a current overheat level error, which is a difference between the overheat level and a target overheat level, at predetermined time intervals;

calculating a slope of the current overheat level error from the current overheat level error and an overheat level error a predetermined period of time in the past;

calculating an opening level increase or decrease value according to the slope of the current overheat level error; and calculating an opening level change value according to the slope of the current overheat level error and the opening level increase or decrease value.

3. The method as set forth in claim 2, wherein, when two of the compressors are simultaneously operated, and the slope of the overheat level error is greater than 0, the opening level change value is calculated based on the equation (opening level change value=A×opening level increase or decrease value+B×slope of overheat level error×opening level increase or decrease value), where A and B are values previously set according to capacities of the compressors.

4. The method as set forth in claim 2, wherein, when two of the compressors are simultaneously operated, and the slope of the overheat level error is less than 0, the opening level change value is calculated based on the equation (opening level change value=A×opening level increase or decrease value−B×slope of overheat level error×opening level increase or decrease value), where A and B are values previously set according to capacities of the compressors.

5. The method as set forth in claim 2 wherein, when only one of the compressors is operated, the opening level change value is calculated based on the equation (opening level change value=C×opening level increase or decrease value+D×slope of overheat level error), where C and D are values previously set according to capacities of the compressors.

6. The method as set forth in claim 1, wherein calculating the new target opening level comprises:

calculating a first opening level change value of the linear expansion valve according to the suction overheat level of the compressors;

calculating a second opening level change value of the linear expansion valve according to the discharge temperature of the compressors;

adding the first opening level change value and the second opening level change value to calculate a final opening level change value; and adding a current opening level value to the final opening level change value to calculate the new target opening level value.

7. The method as set forth in claim 6, wherein calculating the first opening level change value comprises:

calculating an overheat level, which is a difference between a temperature of inlet pipes of the compressors and a temperature of an indoor or outdoor pipe;

calculating a current overheat level error, which is a difference between the overheat level and a target overheat level, at predetermined time intervals;

calculating a slope of the current overheat level error from the current overheat level and an overheat level error a predetermined period of time in the past;

calculating an opening level increase or decrease value according to the slope of the current overheat level error; and calculating the first opening level change value from the slope of the current overheat level error and the opening level increase or decrease value.

8. The method as set forth in claim 7, wherein, when two of the compressors are simultaneously operated, and the slope of the overheat level error is greater than 0, the first opening level change value is calculated based on the equation (first opening level change value=A×opening level increase or decrease value+B×slope of overheat level error×opening level increase or decrease value), where A and B are values previously set according to capacities of the compressors.

9. The method as set forth in claim 7, wherein, when two of the compressors are simultaneously operated, and the slope of the overheat level error is less than 0, the first opening level change value is calculated by based on the equation (first opening level change value=A×opening level increase or decrease value−B×slope of overheat level error×opening level increase or decrease value), where A and B are values previously set according to capacities of the compressors.

10. The method as set forth in claim 7, wherein, when only one of the compressors is operated, the first opening level change value is calculated based on the equation (first opening level change value=C×opening level increase or decrease value+D×slope of overheat level error) where C and D are values previously set according to capacities of the compressors.

11. The method as set forth in claim 6, wherein calculating the second opening level change value comprises:

calculating a target compressor discharge temperature according to an indoor temperature, an outdoor temperature, and operating capacities of the compressors;

calculating a current compressor discharge temperature error, which is a difference between a current compressor discharge temperature and the target compressor discharge temperature, at predetermined time intervals;

calculating an opening level increase or decrease value according to the current compressor discharge temperature error and the operating capacities of the compressors;

calculating a slope of the compressor discharge temperature error from the current compressor discharge temperature error and a compressor discharge temperature error a predetermined period of time in the past; and calculating the second opening level change value from the opening level increase or decrease value and the slope of the compressor discharge temperature error.

12. The method as set forth in claim 11, wherein when the cooling cycle apparatus is operated in a cooling operation mode, the target compressor discharge temperature is calculated based on the equation (target compressor discharge temperature=(indoor temperature−35)×C1+(27−indoor temperature)×C2 +C3), where C1, C2 and C3are values previously set according to capacities of the compressors.

13. The method as set forth in claim 11, wherein when the cooling cycle apparatus is operated in a heating operation mode, the target compressor discharge temperature is calculated by the equation (target compressor discharge temperature=(outdoor temperature−7)×C4+(indoor temperature−20)×C5+C6), where C4, C5and C6 are values previously set according to the capacities of the compressors.

14. The method as set forth in claim 11, wherein, when two of the compressors are simultaneously operated, and the slope of the compressor discharge temperature error is greater than 0, the second opening level change value is calculated by the equation (second opening level change value=E×opening level increase or decrease value+F×slope of compressor discharge temperature error×opening level increase or decrease value), where E and F are values previously set according to capacities of the compressors.

15. The method as set forth in claim 11, wherein, when two of the compressors are simultaneously operated, and the slope of the compressor discharge temperature error is less than 0, the second opening level change value is calculated by the equation (second opening level change value=E×opening level increase or decrease value−F×slope of compressor discharge temperature error×opening level increase or decrease value), where E and F are values previously set according to capacities of the compressors.

16. The method as set forth in claim 11, wherein, when only one of the compressors is operated, the second opening level change value is calculated by the equation (second opening level change value=G×opening level increase or decrease value H×slope of compressor discharge temperature error), where, G and H are values previously set according to the capacities of the compressors.

* * * * *

UNITED STATES PATENT AND TRADEMARK OFFICE

CERTIFICATE OF CORRECTION

PATENT NO. : 7,509,817 B2
APPLICATION NO. : 11/103566
DATED : March 31, 2009
INVENTOR(S) : Yoon Jei Hwang et al.

It is certified that error appears in the above-identified patent and that said Letters Patent is hereby corrected as shown below:

At column 14, line 19 (claim 16 line 5) of the printed patent, “value H x slope” should be -- value + H x slope --.

Signed and Sealed this

Twenty-third Day of June, 2009

JOHN DOLL
*Acting Director of the United States Patent and Trademark Office*